US005150907A

United States Patent [19]

Desmarais et al.

[11] Patent Number: 5,150,907

[45] Date of Patent: Sep. 29, 1992

[54] METHOD OF PLAYING AN EDUCATIONAL GEOGRAPHY GAME

[75] Inventors: Daniel Desmarais, Cypress; Jack R. Wallace, Tustin, both of Calif.

[73] Assignee: 1-800 Geopoly, Laval, Canada

[21] Appl. No.: 712,249

[22] Filed: Jun. 7, 1991

[51] Int. Cl.[5] ..... A63F 3/04

[52] U.S. Cl. ..... 273/240; 273/252; 273/242

[58] Field of Search ..... 273/240, 236, 242, 251–254

[56] References Cited

U.S. PATENT DOCUMENTS

| | | | |
|---|---|---|---|
| 1,137,167 | 4/1915 | Pridmore | 434/131 |
| 3,254,893 | 6/1966 | Serviere | 273/240 |
| 3,638,946 | 2/1972 | Bain | 273/254 |
| 4,095,800 | 6/1978 | Konsolas | 273/251 |
| 4,116,449 | 9/1978 | Breslow | 273/240 |
| 4,141,156 | 2/1979 | Holtvoigt | 362/809 |
| 4,283,059 | 8/1981 | Beeder | 273/254 |
| 4,411,432 | 10/1983 | Stevens | 273/251 |
| 4,679,798 | 7/1987 | Dvorak et al. | 273/254 |
| 4,887,818 | 12/1989 | Escott | 273/254 |
| 4,896,888 | 1/1990 | Owen | 273/240 |

FOREIGN PATENT DOCUMENTS

| | | | |
|---|---|---|---|
| 2231806 | 11/1990 | United Kingdom | 273/258 |

*Primary Examiner*—Benjamin H. Layno

*Attorney, Agent, or Firm*—Herbert L. Lerner; Laurence A. Greenberg

[57] ABSTRACT

A geography game is disclosed which comprises selecting locations on a map for players occupying certain playing positions. Access rights to the selected locations are established. Travelling routes are draw in lines interconnecting locations to which the player owns an access right. If a second player must travel to a location via a route, he may have to pay for accessing that location. In an alternative embodiment, the object is to close in a player who is not allowed to cross a route drawn with a line on the map.

14 Claims, 1 Drawing Sheet

METHOD OF PLAYING AN EDUCATIONAL GEOGRAPHY GAME

BACKGROUND OF THE INVENTION

1. Field of the Invention

The invention relates to an educational geography game which is played with a geographic map or a world globe.

2. Description of the Prior Art

There exist a vast number of educational geography games in the prior art. Typical games include a map with certain paths printed thereon and game pieces for travelling the given routes as well as some type of method of chance by which the route and/or the distance to be travelled is determined.

One game apparatus of that type is that disclosed in U.S. Pat. No. 3,638,946 to Bain. Playing cards and a chance number indicator determine a distance to be travelled and the player moves his game piece on the map along a given route. Also employed are a die or dice and a departure book for accelerated travel by air.

A game which relates to worldwide air travel is disclosed in U.S. Pat. No. 4,887,818 to Escott. In several respects similar to one of the most popular of all board games, MONOPOLY, the Escott travel game uses a world map with imprinted airline routes. The players travel from one location to another by moving their travel tokens and they purchase air routes with the play money provided for that purpose.

It is common to all of the prior art games that travel routes are already predetermined and imprinted on the map. Most games also utilize game pieces for movement along the given paths. Accordingly, only rather few geographic locations will be visited during the course of a game and, furthermore, the locations will be the same every time those games are played. Finally, it appears that most of the games are overly complicated and thus cannot be played by children under a certain age.

SUMMARY OF THE INVENTION

It is accordingly an object of the invention to provide an educational geography game, which overcomes the hereinafore-mentioned disadvantages of the heretofore-known devices of this general type and which will be able to teach geography as well as entertain persons of various age groups. The game provided may be played at different levels of difficulty and, accordingly, it may be played by children of very young age.

With the foregoing and other objects in view there is provided, in accordance with the invention, a method of playing a geography game with a map which comprises the steps of a) selecting a playing order having at least first and second positions; b) selecting a location on the map for the first player and determining an access right to the location for the first player; c) selecting at least one other location on the map for the first player and determining an access right to the other location for the first player; d) drawing a line by the first player connecting the locations representing a route, and determining ownership of the route for the first player; e) travelling to locations via routes by the second player; f) reimbursing the owner of a route if that route must be travelled by the second player; g) changing the playing order so that other players occupy the at least first and second playing positions; and h) repeating steps b), c), d) e) f) and g) until the game is terminated.

The game may be played with two players, several players, two or more groups of players or in solitaire. The participants themselves draw the routes between cities on the map and the cities are determined by chance. Accordingly, each game will lead to a different travel net and cities which will be found by the players in many cases to be cities that they would otherwise not even be aware of.

Crossing another players route may be restricted in varying degrees which eventually may result in a player not being able to move on and thus be disqualified.

A certain amount of play money may be distributed at the beginning of the game. When players must be reimbursed for the use of their routes, a player may eventually run out of money and thus become disqualified from the game.

In accordance with another feature of the invention, the game is played on a world globe.

In accordance with an added feature of the invention, the line is drawn on the map or the globe with erasable markers and each player is assigned a different color marker so that the ownership of the respective routes is easily recognizable. Instead of erasable markers one may also use a clear plastic foil to be placed over the map for each game. After the game, the foil may be disposed of and a fresh, unmarked foil may be used for the next game.

In accordance with again another feature of the invention, locations for which access rights are established, are selected by change using a die or a spinning needle, and locations to which players must travel to, are also selected by chance using cards showing flags of different countries.

Other features which are considered as characteristic for the invention are set forth in the appended claims.

Although the invention is illustrated and described herein as embodied in an educational geography game, it is nevertheless not intended to be limited to the details of the method described and shown, since various modifications and structural changes may be made therein without departing from the spirit of the invention and within the scope and range of equivalents of the claims.

The method of the invention, however, together with additional objects and advantages thereof will be best understood from the following description of the specific drawings when read in connection with the accompanying drawings.

DESCRIPTION OF THE PREFERRED EMBODIMENTS

Figure 1:
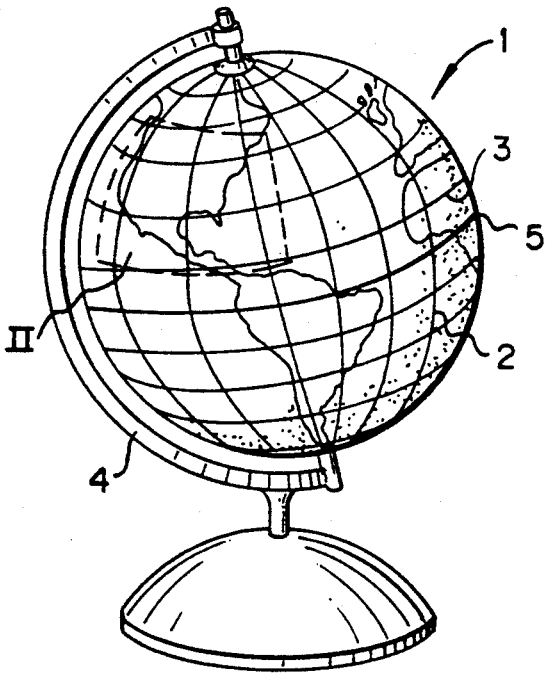
FIG. 1 is a perspective view of a world globe.

Referring now to the figures of the drawing in detail and first, particularly, to FIG. 1 thereof, there is seen a world globe 1 having a typical grid of perpendicular lines used to indicate geographical locations by longitudes 2 and latitudes 3. Also indicated on the globe are the Americas, Europe and Africa. For the purpose of the instant invention, it may be preferable to use a smooth globe. However, an engraved or relief-type globe may also be used.

A meridian ring 4 extends from pole to pole and it is calibrated to show the degrees of latitude. Accordingly, exact locations on the globe may be unambiguously defined by rotating the globe ball until the specific location comes to lie just below the meridian ring 4. The degree of latitude can then be read directly from the calibration on the meridian ring 4 and the longitude may be read from the intersection of the equator with the meridian ring 4. Any geographic location may therefore be indicated either by its name or by its world coordinates.

Depending on the size and accuracy of the globe, one may read the coordinates to degrees of latitude and longitude and possibly even to minutes. However, for the purpose of this invention it may suffice to employ a globe which allows the coordinates to be read within two or three degrees, so that the exact coordinates may be estimated within one degree.

Furthermore, the meridian ring 4 and an equatorial scale 5, as well as a non-illustrated horizon ring may alternatively be calibrated in miles, kilometers, hours of travel time, or simply be subdivided into a given number of fields. Such a number of subdivisions may correspond to the possible numbers on a die which is six, or twelve if the game is played with two dice. Alternative methods of chance corresponding to the dice would be number wheels, spinning needles, wheels of fortune or a deck of cards.

Figure 2:
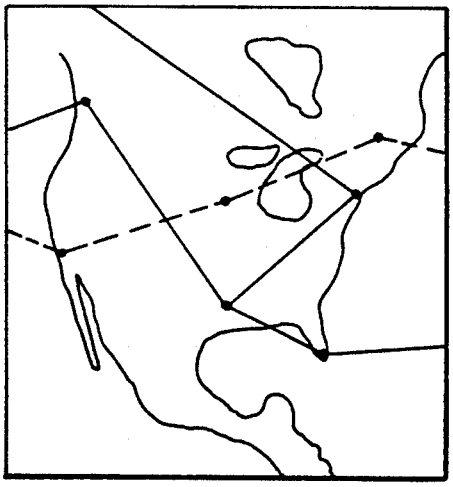
FIG. 2 is an enlarged detail from the surface of the globe corresponding to the section II of FIG. 1.
Figure 5:
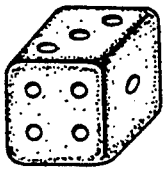
FIG. 5 is a perspective view of rolling die.
Figure 6:
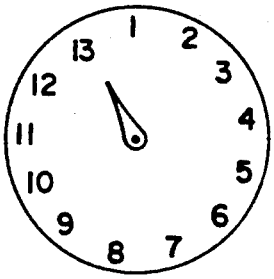
FIG. 6 is an elevational view of a spinning needle.
Figure 7:
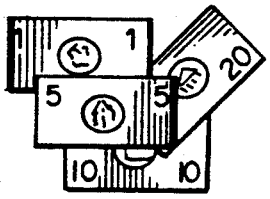

As shown in FIG. 2, the player using a black marker owns the air routes from Miami to Houston, from Houston to New York and Seattle, etc. The player with the red marker, as indicated by the dashed lines, has reserved the routes into Los Angeles, from Los Angeles to Minneapolis, from Minneapolis to Montreal, and from Montreal to some non-illustrated European location.

Figure 3:
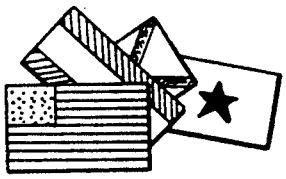
FIG. 3 is a top-plan view of a deck of cards showing country flags.
Figure 4:
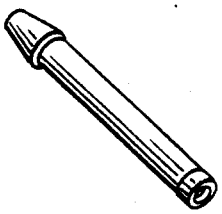
FIG. 4 is an elevational view of a marker.

As shown in FIG. 3, a deck of cards is used for identifying a certain location. The cards may represent country flags, which is an additional educational advantage, or they may simply give the name of a certain country or city to which the respective player should travel.

By way of example, the game would be played in the following manner: Each player is given an erasable or washable marker of a certain color. Rolling the die or dice establishes the latitude and longitude coordinates. Accordingly, access rights are established in the city at which the geographic coordinates most closely correspond to the numbers rolled with the dice. The route to another city whose access right that player owns is then drawn on the map or the globe by the respective player with the erasable marker.

Subsequently, the dice are passed on to an opposing player, who must draw from the deck of cards. If that player draws a card which mandates that he fly to a certain city via a route which is already drawn, he must pay the player who owns that route. Play money, similar to and commonly known as "monopoly money", is provided for that purpose. The player who, at the end of the game, has collected the most fares is the winner.

EXAMPLE 1

Players buy airports in cities on the map; players draw lines, representing routes, interconnecting their own airports and determining ownership of these routes for the players having drawn them. Players also travel between cities as mandated by chance; fare is paid by travelling players to owners of travelled routes.

EXAMPLE 2

At the beginning of the game, each player is given a different color erasable marker and is assigned a certain starting location, e.g. Paris, France. Player A, by way of rolling the dice, establishes his landing right in Miami, Florida, since his rolled numbers correspond to these coordinates. Player A now draws a line from Paris to Miami with his black marker. Now, all of the opposing players must each draw a card from the deck of flags. Player B, whose established starting location was also Paris draws the flag of Japan. Since no routes are yet established to Japan, he will not fly. Player C, however, has drawn the flag of the U.S. and will have to use the established route into Miami and, accordingly, he will have to pay a certain amount to player A. After all of the opposing players have made their moves, it is now up to Player B to roll the dice.

By rolling the coordinates of New York, player B will now draw a line from Paris to New York with his red marker, thus indicating his ownership of that route. All of the other players now have to draw a card and utilize any of the established routes to whichever country they are required to travel. Towards the end of the game, many different routes may have been established, so that it becomes less and less likely that a player cannot travel to his destination. On the other hand it may happen that a player will have to travel around the world just to reach Canada from New York, for example, if a direct route has not been established. Accordingly, that player will also have to pay a large amount of money for what would have appeared to be a very short trip.

EXAMPLE 3

The game is played in a similar manner as in Example 1. A requirement of the rules in this case is that an opposing player's line, i.e. route, must not be crossed. The object of this game is to eventually encircle the opposing player so that he can no longer move, at which point the encircled player is disqualified.

The routes may be air routes, train tracks, streets or waterways.

A "map", for the purpose of this application, may be in the form of printed paper, a globe, a hologram and any structurally similar equivalents and the word is to incorporate such meaning.

We claim:

1. Method of playing an educational geography game with a map, which comprises:

a) providing a map, an apparatus of chance and marking means;

b) determining locations on the map for a player by selecting the locations by chance and marking the selected locations;

c) drawing lines by the player on the map representing routes interconnecting the locations;

d) determining ownership of the routes for the player by marking the routes with markings distinctly associated with the respective player;

e) defining starting locations and destination locations on the map for the players and travelling along the routes by the players from the starting locations to the destination locations; and f) repeating steps a)–e) in a given order by a given player.

2. The method according to claim 1, which comprises restricting a player from drawing a line across another line.

3. The method according to claim 1, which comprises providing play money and determining an amount of play money owed to the owner of the route being travelled, the amount being proportional to a length of the route being travelled, and crediting the owner with the amount of play money in exchange for a right to travel the route.

4. Method of playing an educational geography game with a map, which comprises:

a) providing a map and marking means;

b) selecting a playing order having at least first and second playing positions;

c) selecting a location on the map for the first player and determining an access right to the location for the first player by distinctly marking the location to be associated with the first player;

d) selecting at least one other location on the map for the first player and determining an access right to the other location for the first player by distinctly marking the other location;

e) drawing a line by the first player connecting the locations representing a route, and determining ownership of the route for the first player by distinctly marking the route;

f) changing the playing order so that other players occupy the at least first and second playing positions; and g) repeating step c), d), e) and f) until the game is terminated.

5. The method according to claim 4, which comprises mounting the map on a world globe.

6. The method according to claim 4, which further comprises providing play money and determining an amount of play money owed to the owner of a route if that route must be travelled by a player occupying the second playing position, the amount being proportional to a length of the route being travelled, and crediting the owner with the amount of play money in exchange for a right to travel the route.

7. The method according to claim 4, which comprises drawing the line on the map with erasable markers and assigning each player a different color marker so that the ownership of the respective routes and access rights to the locations is easily recognizable.

8. The method according to claim 4, which comprises traveling to locations via routes by a player occupying the second playing position.

9. The method according to claim 4, which comprises providing a map having latitudes and longitudes marked thereon, and selecting the location with at least one die by associating numbers rolled with the at least one die with the latitudes and longitudes on the map.

10. The method according to claim 4, wherein the locations are countries and which comprises selecting the location to be travelled to with a card showing flags of different countries.

11. The method according to claim 4, which comprises selecting the location to be travelled to by chance.

12. The method according to claim 4, which comprises providing a spinning needle with a dial having markings thereon and selecting the location with the spinning needle by associating markings on the dial with the location.

13. The method according to claim 4, which comprises occupying the first and second playing positions by one player.

14. The method according to claim 4, which comprises restricting a player from drawing a route across a route already drawn.

* * * * *